US009173819B2

(12) United States Patent
Leung

(10) Patent No.: US 9,173,819 B2
(45) Date of Patent: Nov. 3, 2015

(54) MUSIC PACIFIER

(76) Inventor: Elton Yu Man Leung, Kowloon (HK)

( * ) Notice: Subject to any disclaimer, the term of this patent is extended or adjusted under 35 U.S.C. 154(b) by 675 days.

(21) Appl. No.: 12/992,087

(22) PCT Filed: Jun. 2, 2009

(86) PCT No.: PCT/CN2009/072081

§ 371 (c)(1),
(2), (4) Date: Nov. 11, 2010

(87) PCT Pub. No.: WO2009/152727

PCT Pub. Date: Dec. 23, 2009

(65) Prior Publication Data

US 2011/0082501 A1 Apr. 7, 2011

(30) Foreign Application Priority Data

Jun. 17, 2008 (CN) ..... 2008 2 0119206 U

(51) Int. Cl.
*A61J 17/00* (2006.01)

(52) U.S. Cl.
CPC ..... *A61J 17/00* (2013.01); *A61J 1/1418* (2015.05); *A61J 17/002* (2015.05)

(58) Field of Classification Search
CPC ..... A61J 2017/002; A61J 17/00–17/008
USPC ..... 606/234–236
See application file for complete search history.

(56) References Cited

U.S. PATENT DOCUMENTS 4,554,919 A * 11/1985 Hubert ..... 606/234
4,726,376 A * 2/1988 Dahan ..... 606/234
5,540,719 A * 7/1996 Covelli-Ingwell et al. ... 606/234
5,662,685 A * 9/1997 Uhler ..... 606/234
5,693,073 A * 12/1997 Glick et al. ..... 606/236
5,865,711 A * 2/1999 Chen ..... 482/57
6,066,161 A * 5/2000 Parella ..... 606/234
6,102,935 A * 8/2000 Harlan et al. ..... 606/234
6,193,742 B1 * 2/2001 Moriarty ..... 606/234
7,703,848 B1 * 4/2010 Cochran et al. ..... 297/256.16
2004/0168565 A1 * 9/2004 Nagao et al. ..... 84/633
2007/0230719 A1 * 10/2007 Filo et al. ..... 381/150
2008/0197097 A1 * 8/2008 Montgomery ..... 215/11.2

* cited by examiner

*Primary Examiner* — Katherine Rodjom
*Assistant Examiner* — Kendra Obu
(74) *Attorney, Agent, or Firm* — Raymond R. Ferrera; Adams and Reese LLP

(57) ABSTRACT

A music pacifier (100) includes a pacifier frame (101) and a nipple (102) which locates at the one side of the frame and a container (106) locates on the other side of the frame. Within the container (106), there is a music IC & power supply (108), an insulating house (109), and a vibrating transducer (110). The insulating house (109) made of soft material is used to insulate the vibration produced. The vibrating transducer (110) is used to convert the pre-stored music into vibration. It locates in the above-mentioned house and connects with the above-mentioned music IC. There is also a vibrating tongue (111) which is used to pass the vibration produced by the above-mentioned vibrating transducer to an infant's jaw, including a contacting part (114) of the above-mentioned vibrating transducer which locates in the above-mentioned house as well as a tongue (113) which protrudes from the above-mentioned house and extends into the above-mentioned nipple.

10 Claims, 2 Drawing Sheets

MUSIC PACIFIER

CROSS REFERENCE TO RELATED APPLICATIONS

Pursuant to 35 U.S.C. §119(a), the instant application claims priority to prior Hong Kong Application No. 200820119206.6, filed on Jun. 17, 2008, and PCT Application No. PCT/CN2009/072081, filed on Jun. 2, 2009.

FIELD OF THE INVENT

This invention relates to a pacifier, specifically, a kind of music pacifier.

BACKGROUND OF THE INVENTION

Infants are happy with objects that can draw their attentions. Pacifiers contact infant's lips, thus becoming a very easy amusement. In many instances, sound and music may draw infant's attention. However, in some occasions which the environment is quiet, such as churches, airplanes and restaurants, toys that produce sound or music are not appropriate. Although earphones can provide individual music environment which avoid disturbing the others, infant's ears are just too small to use earphones. Also, using earphones for too long may impair their hearings.

SUMMARY OF THE INVENTION

In current technology, pacifiers usually only provide physical contacts. Some other sound-making toys have the limitation for quiet occasions. The solution provided by this invention is that this music pacifier can pass the vibration of sound directly to an infant's ear though their jaw. Other people can not hear the sound.

The technical solution adopted by this invention is: building up a music pacifier, including a pacifier frame and a nipple locates on one side of the pacifier frame. A container that locates on the other side of the above-mentioned pacifier frame can be dismounted from the above-mentioned pacifier frame. The above-mentioned container has:

A music IC & power supply;

A house which is used to insulate vibration is made of soft material. There is gap between the house and the above-mentioned music IC & power supply;

A vibrating transducer which is used to convert the pre-stored music into vibration locates in the above-mentioned house and connects with the above-mentioned music IC; and A vibrating tongue is used to pass the vibration produced by the above-mentioned vibrating transducer to an infant's jaw. It includes a contacting part that locates in the above-mentioned house and contacts the above-mentioned vibrating transducer. It protrudes from the above-mentioned house into the hollow space of the above-mentioned nipple.

In the above-mentioned music pacifier of this invention, the above-mentioned vibrating tongue has a T-shaped section, including the above-mentioned tongue at the front and the above-mentioned contacting part at the rear.

In the above-mentioned music pacifier of this invention, the above-mentioned vibrating transducer has an arc vibrating surface. The above-mentioned vibrating tongue's contacting part contacts the above-mentioned arc vibrating surface.

In the above-mentioned music pacifier of this invention, a locking eye locates on one side of the above-mentioned pacifier frame, a locking tab locates on the above mentioned container. The above-mentioned locking tab and the above-mentioned locking eye match each other.

In the above-mentioned music pacifier of this Invention, the first through hole locates within the locking tab of the above-mentioned container. There is a protrusion on the above-mentioned house, the above-mentioned protrusion protrudes from the above-mentioned first through hole; the above-mentioned vibrating tongue protrudes from the above-mentioned protrusion and extends into the above-mentioned nipple.

In the above-mentioned music pacifier of this invention, the above-mentioned house is made of rubber or silica gel.

In the above-mentioned music pacifier of this invention, the above-mentioned pacifier frame is made of hard plastic.

In the above-mentioned music pacifier of this invention, the above-mentioned music pacifier also includes a switch button which connects with the above-mentioned music IC, the above-mentioned switch protrudes from the above-mentioned container.

In the above-mentioned music pacifier of this invention, the above-mentioned music pacifier also includes a charging plug which connects with the above-mentioned music IC & power supply.

The music pacifier in this invention has following beneficial results: when an infant sucks the nipple, her teeth or jaw contacts the vibrating tongue through the pacifier nipple. The pre-stored music may pass into the infant's jaw through vibration, then further into her internal ear so that the music can be heard. Since the house is made of soft material, the vibration is insulated. This prevents the sound from being transferred to outside via resonance of other parts of the pacifier. No sound can be heard by surrounding people. Therefore, the music pacifier fits the occasion where quietness is required.

BRIEF DESCRIPTION OF THE DRAWINGS

The invention is further illustrated by using the attached figures and a practical example. Among the attached figures.

DETAILED DESCRIPTION OF THE PREFERRED EMBODIMENT

Figure 1:
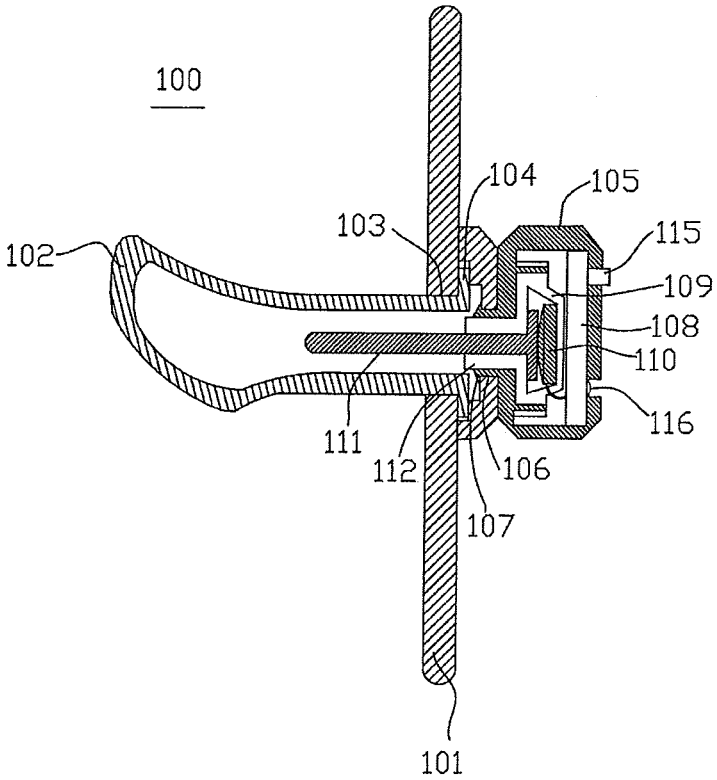
FIG. 1 is the cutaway view of the music pacifier in this invention.
Figure 2:
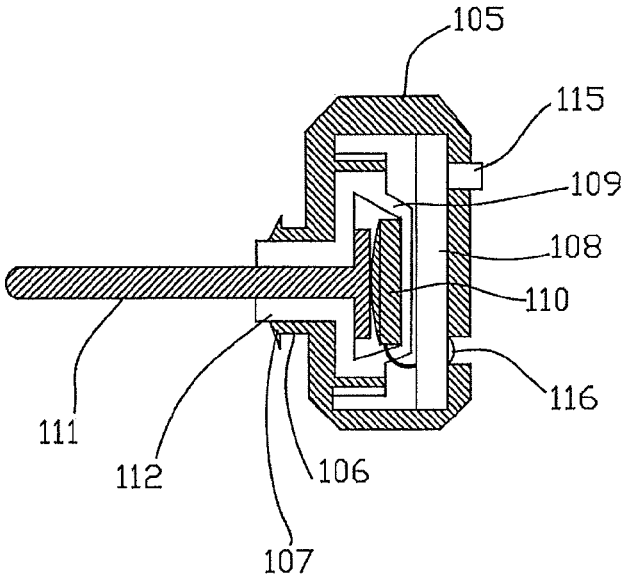
FIG. 2 is the cutaway view of the music pacifier's vibrating module in this invention.

As shown in FIG. 1 and FIG. 2, the music pacifier 100 in this invention includes a pacifier frame 101 which is made of hard plastic, a silica gel nipple 102 which locates at the first side of the pacifier frame 101 and a vibrating module which locates at the second side of the pacifier frame 101. A hole 103 locates on the pacifier frame 101. The rear end of the silica gel nipple 102 passes through the hole 103, through the protrusion 104 at the rear end, contacts and positions on the second side of the pacifier frame 101.

The vibrating module locates at the second side of the pacifier frame 101 includes a container that connects the pacifier frame 101. A locking eye locates on the second side of the pacifier frame 101 and a locking tab locates on the container 107. The locking tab and the locking eye match each other, making a dismountable installation. If the nipple 102 needs to be cleaned, it can be done by dismounting the container 105 from the pacifier frame 101, avoid shorting or damaging the electronic circuit in the container.

The first through hole locates within the locking tab 107 of the container 106. A music IC & power supply 108 as well as a house 109 which is used to insulate the vibration locate in the container 106. A vibrating transducer 110 and a plastic vibrating tongue 111 locate in the house 109. This house 109 is made of soft material, such as, rubber, silica gel, etc. The house wraps around the vibrating transducer 110 and the vibrating tongue 111, making them hang in the air within the container. This is to buffer the vibration of the two parts, ensuring no vibration will pass to container 106 and pacifier frame 101 thus preventing them from generating resonance and sound.

Figure 3:
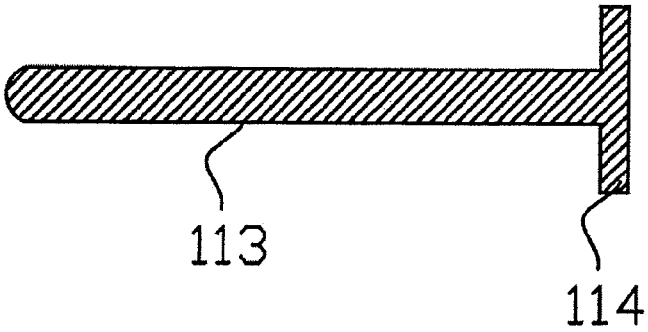
FIG. 3 is the cutaway view of the vibrating tongue in this invention.

As shown in the figure, there is a gap between the house 109 and the music IC & power supply 108, they do not contact each other. The house 109 has a protrusion 112, it protrudes from the first through hole within the locking tab 106 of the container. The 2nd through hole locates on the protrusion 112 of the house 109. The vibrating transducer 110 locates in the container 105 and electronically connects with the music IC & power supply 108 in order to convert the pre-stored music into vibration. FIG. 3 shows that the vibrating tongue 111 has a "T"-shaped section, including the tongue 113 at the front and the contacting part 114 at the rear. The contacting part 114 contacts with the arc vibrating surface of the vibrating transducer 110. When the vibrating transducer 110 vibrates, it passes the vibration to the vibrating tongue 111. The tongue 113 at the front of the vibrating tongue 111 is a lathy slice, it protrudes from the protrusion 112 of the house 109 and extends into the silica gel nipple 102.

The music pacifier 100 also includes a switch button 115 and a charging plug 116 which connect the music IC & power supply 108. The switch button 115 extends from the container 105. When the switch button 115 is pressed, the music IC will be switched on and the music will be played, thus making the vibrating tongue 111 to vibrate. When the switch button 115 is pressed once again, the music will be stopped. The music, sequence and duration of playing can be determined according to the program stored in the music IC. The music pacifier can be recharged by connecting the music IC & power supply 108 thought the charging plug 116 to an external power supply.

When an infant sucks the nipple 102, her teeth or jaw contacts with the vibrating tongue through the nipple, the pre-stored music passes to the infant's jaw through vibration, then to his/her internal ear thus make the music to be heard. Since the house is made of soft material, the vibration is insulated. This prevents the sound from being transferred to outside via resonance of other parts of the pacifier. No sound can be heard by surrounding people. Therefore, the music pacifier fits the occasion where quietness is required.

The invention claimed is:

1. A music pacifier, comprising:

a pacifier frame, having a front side and a back side, a nipple comprising a hollow space, located on the front side of the pacifier frame, and a container defining an interior cavity, connected to the back side of the pacifier frame, wherein said container is capable of being dismounted from the back side of the pacifier frame, further wherein the interior cavity of the container comprises:

A music IC, comprising pre-stored music, and a power supply;

An insulating house capable of insulating vibration, said insulating house comprising soft material, a vibrating transducer configured to convert pre-stored music into vibration, mechanically connected to the music IC, and a vibrating tongue capable of passing the vibration produced by the vibrating transducer to an infant's jaw, including a contacting part located in the insulating house and abutting the vibrating transducer, further wherein the vibrating tongue stretches from the insulating house into the hollow space of the nipple;

wherein the music pacifier does not emit audible sound.

2. The music pacifier of claim 1, wherein the vibrating tongue comprises a T-shaped section.

3. The music pacifier of claim 1, wherein the vibrating transducer comprises an arc vibrating surface, wherein the contacting part of the vibrating tongue contacts the arc vibrating surface.

4. The music pacifier of claim 1, wherein the pacifier frame further comprises a locking eye on the back side of the pacifier frame, and the container comprises a locking tab, wherein the locking tab and the locking eye are capable of interlocking with each other.

5. The music pacifier of claim 4, wherein the locking tab comprises a first through hole, and the insulating house comprises a protrusion, wherein the protrusion extends from the first through hole, and the vibrating tongue protrudes from the protrusion and extends into the nipple.

6. The music pacifier of claim 1, wherein the insulating house comprises rubber.

7. The music pacifier of claim 1, wherein the pacifier frame comprises hard plastic.

8. The music pacifier of claim 1, wherein the music pacifier further comprises a switch button connected to the music IC, wherein the switch button protrudes from the container.

9. The music pacifier of claim 1, wherein the music pacifier further comprises a charging plug connected to the music IC and the power supply.

10. The music pacifier of claim 1, wherein the insulating house comprises silica gel.

* * * * *